US009820596B2

(12) United States Patent
Eastman

(10) Patent No.: US 9,820,596 B2
(45) Date of Patent: Nov. 21, 2017

(54) SELF-FEEDING APPARATUS

(71) Applicant: Judy Jericho Eastman, Tallahassee, FL (US)

(72) Inventor: Judy Jericho Eastman, Tallahassee, FL (US)

( * ) Notice: Subject to any disclaimer, the term of this patent is extended or adjusted under 35 U.S.C. 154(b) by 0 days.

(21) Appl. No.: 14/926,025

(22) Filed: Oct. 29, 2015

(65) Prior Publication Data

US 2017/0119185 A1 May 4, 2017

(51) Int. Cl.

| | |
|---|---|
| ***B25J 13/08*** | (2006.01) |
| ***A47G 21/08*** | (2006.01) |
| ***A47G 21/02*** | (2006.01) |
| ***A47G 21/04*** | (2006.01) |

(52) U.S. Cl.

CPC ..... *A47G 21/08* (2013.01); *A47G 21/02* (2013.01); *A47G 21/04* (2013.01)

(58) Field of Classification Search

CPC . A47G 21/08; A61F 4/00; A63F 2003/00908; B25J 11/008; B25J 15/0206; B25J 9/0084; B25J 9/0096; B25J 9/04; B25J 11/009; B25J 9/1682; B25J 13/06; G05B 2219/45111; Y10S 700/90

USPC ..... 414/9

See application file for complete search history.

(56) References Cited

U.S. PATENT DOCUMENTS 929,897 A * 8/1909 Taylor ..... A47F 5/02 211/70
2,120,571 A * 6/1938 Reichenstein ..... A01K 97/26 269/11
2,446,016 A * 7/1948 Lessin ..... A47G 21/14 211/70
3,848,943 A * 11/1974 Geesaman ..... A47B 81/04 206/373
4,522,543 A * 6/1985 Robinson ..... A47G 21/08 222/342
5,330,065 A * 7/1994 Bradley ..... B01D 41/04 108/139
5,361,915 A * 11/1994 Cohen ..... A47G 21/14 211/163
5,379,885 A * 1/1995 Chen ..... B25H 3/06 206/216
5,676,261 A * 10/1997 Baughman ..... A47B 49/004 211/163
5,775,518 A * 7/1998 Connor ..... A47G 21/14 211/163
6,241,105 B1 * 6/2001 Pomper ..... A47F 5/04 206/6.1
6,592,315 B2 * 7/2003 Osborne, Jr. ..... A47G 21/08 414/730

(Continued)

*Primary Examiner* — Gregory Adams
(74) *Attorney, Agent, or Firm* — Wayne Edward Ramage; Baker Donelson

(57) ABSTRACT

An apparatus allowing an individual to feed himself or herself without the use of their hands and without requiring assistance. An eating utensil is held by a utensil holder mounted on the top of a rotating shaft. The rotating shaft is fixedly attached to a rotary disk. The rotary disk is rotatably connected to a fixed shaft, which in turn is fixedly mounted to a base. The user removes the utensil from the mount using his or mouth, obtains a portion of food using the utensil, places the utensil back on the mount, and rotates the mount 180 degrees so the portion of food can thereby be consumed.

10 Claims, 11 Drawing Sheets

(56) References Cited

U.S. PATENT DOCUMENTS

| | | | | |
|---|---|---|---|---|
| 6,705,815 | B1 * | 3/2004 | Bennett | A47G 21/08<br>414/733 |
| 2013/0160298 | A1 * | 6/2013 | Roberts | A47G 21/04<br>30/125 |

* cited by examiner

SELF-FEEDING APPARATUS

FIELD OF INVENTION

This invention relates to an apparatus and method for an individual to feed himself or herself without the use of hands.

BACKGROUND OF THE INVENTION

Feeding oneself without the use of hands is a difficult, nearly impossible task. In general, a person who cannot use their hands to pick up and hold utensils is limited to using straws or the like to consume liquids or liquefied food items. Alternatively, the person must rely on a caregiver to manipulate utensils.

Accordingly, what is needed is an apparatus that allows a person to eat normal food items without the use of hands.

SUMMARY OF INVENTION

In various exemplary embodiments, the present invention comprises an apparatus allowing an individual to feed himself or herself without the use of their hands and without requiring assistance. In one embodiment the invention comprises an eating utensil that is held by a utensil holder mounted on the top of a rotating shaft. The rotating shaft is fixedly attached to a rotary disk, which is fixed to a waveform block with a sinusoidal or waveform face, thereby forming the upper portion of the assembly. The upper portion of the assembly is rotatably connected to the lower portion of the assembly, which comprises a roller block fixedly mounted to a base. The base is weighted so as to provide a stable and secure platform for the apparatus. The roller may be unitary with the base, or be attached with a screw, bolt or other similar means.

In use, the utensil holder, rotating shaft, waveform block, and rotary disk all rotate in unison, while the lower portion of the assembly remains fixed. The user can cause the rotation of the upper elements of the apparatus through a variety of means, including, but not limited to, using their chin, cheek, or other body part to push one end of the utensil to either side when the utensil is in the holder. The utensil is held in place by one or more prongs extending upward from the top of the holder, although other means of securing the utensil can be used, such as a slot or indentation in the top of the holder.

The utensil can be any utensil usable for eating, including, but not limited to, some form of a spoon, fork, or combinations thereof. As shown in the figures, the utensil may comprise a type of spoon, with one end comprising the bowl, and the handle end counterweighted to balance the bowl when loaded with a normal portion of food. The handle end is sized appropriately to allow the user to pick up the utensil with their mouth, and manipulate the utensil while thus held. The shaft of the utensil is appropriately dimensioned to fit securely within the top of the holder, but also allow the user to easily place or remove the utensil on the holder through manipulation of the handle end when held in the mouth. In one embodiment, the shaft of the utensil comprises a hole or indentation that passes partway or wholly through the shaft, and is positioned to engage a tab or post extending from the top of the rotary shaft. This helps the user position the utensil in a balanced position, and secures the utensil until the user lifts the utensil off of the holder.

The utensil may be made of any suitable material, including, but not limited to, metal, plastic, wood, or combinations thereof. In one embodiment, the handle end is made of a plastic that allows the user to securely engage and hold the utensil with their teeth.

The rotary disk generally resists rotation unless the user causes rotation of the upper elements of the apparatus as described above. Resistance can be provided through the position of the sinusoidal/waveform face as the waveform block rests on rollers in the roller block. As the upper portion of the device rotates, the high points and the low points of the sinusoidal/waveform face come into sequential contact with the rollers, so that the apparatus has at least two positions where the relative position of the upper and lower portions of the apparatus are stable (i.e., the upper portion will not rotate from that position without the user applying a force in either direction, as described above). Gravity keeps the upper portion of the apparatus in this position. Movement from these positions require moving the upper portion upwards against gravity as he upper portion rotates.

In several embodiments, the rotary disk is weighted so as to assist in rotation of the upper portion of the assembly. The rotary disk may vary in thickness, so that the weight is distributed more along the perimeter. As the user initiates movement, the sinusoidal or wave form of the upper assembly moves relative to the other, until it reaches a point where the forces cause the upper assembly to the next stable position. In the embodiment shown, the upper portion thus rotates from stable position at 0 degrees, through the maximum unstable position at 90 degrees, to another stable position at 180 degrees. This enables the user to place the utensil on the utensil mount, and rotate it 180 degrees so that he or she can engage the bowl end and consume food items thereon.

DETAILED DESCRIPTION OF EXEMPLARY EMBODIMENTS

Figure 1:
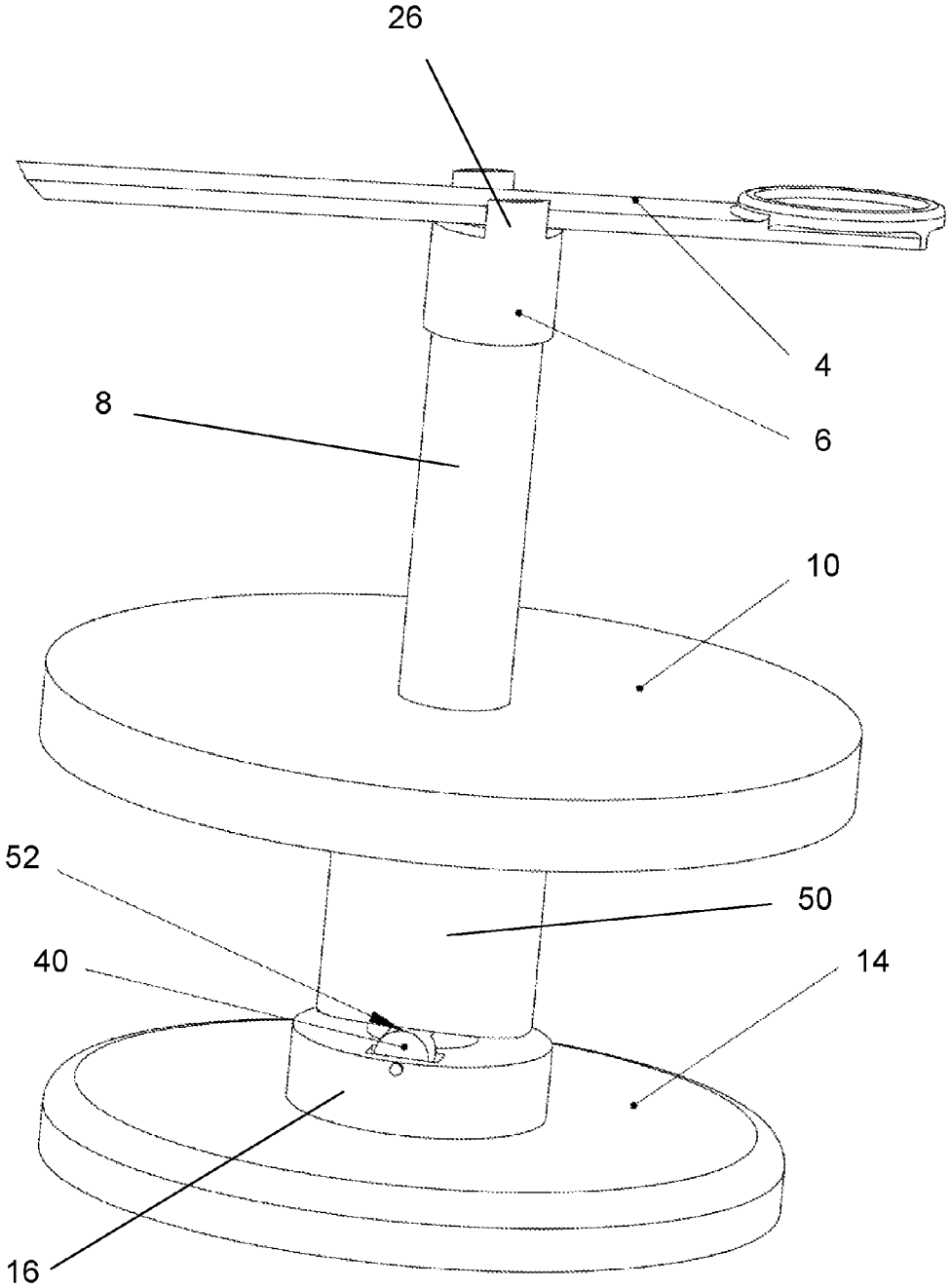
FIG. 1 shows a perspective view of a self-feeding apparatus in accordance with an embodiment of the present invention.
Figure 2:
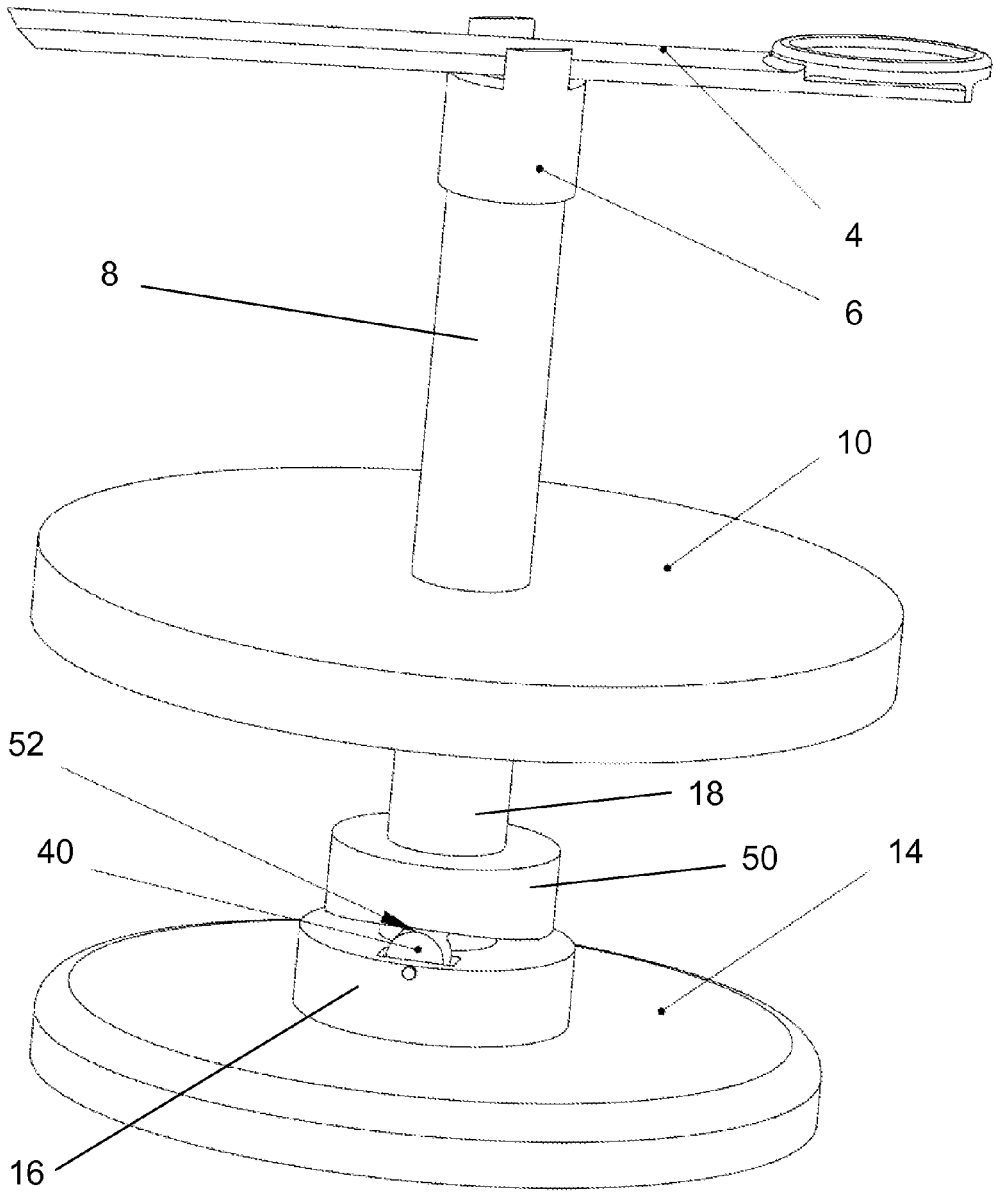
FIG. 2 shows a perspective view of another embodiment of a self-feeding apparatus.
Figure 3:
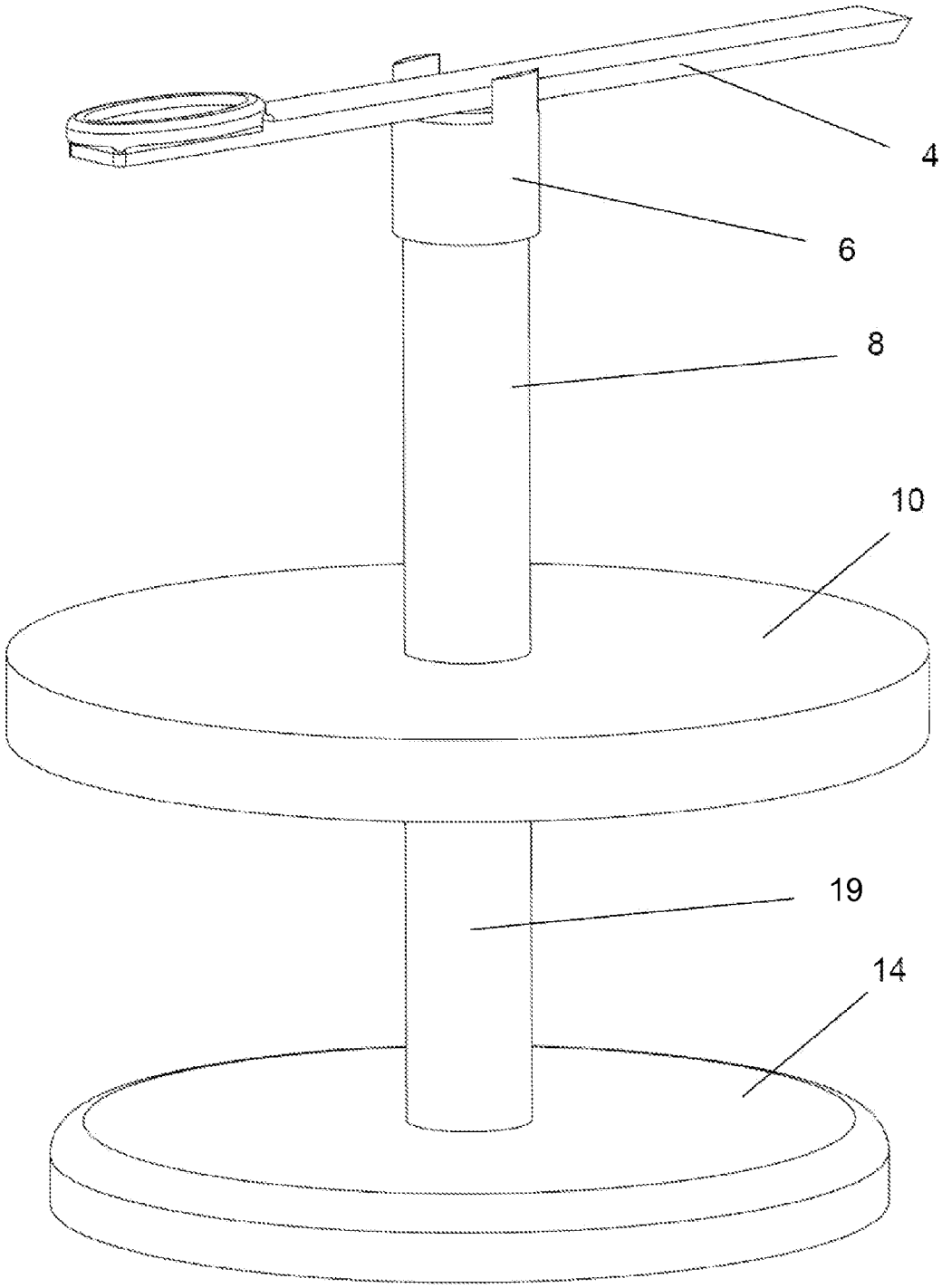
FIG. 3 shows a perspective view of a further embodiment of a self-feeding apparatus.
Figure 4A:
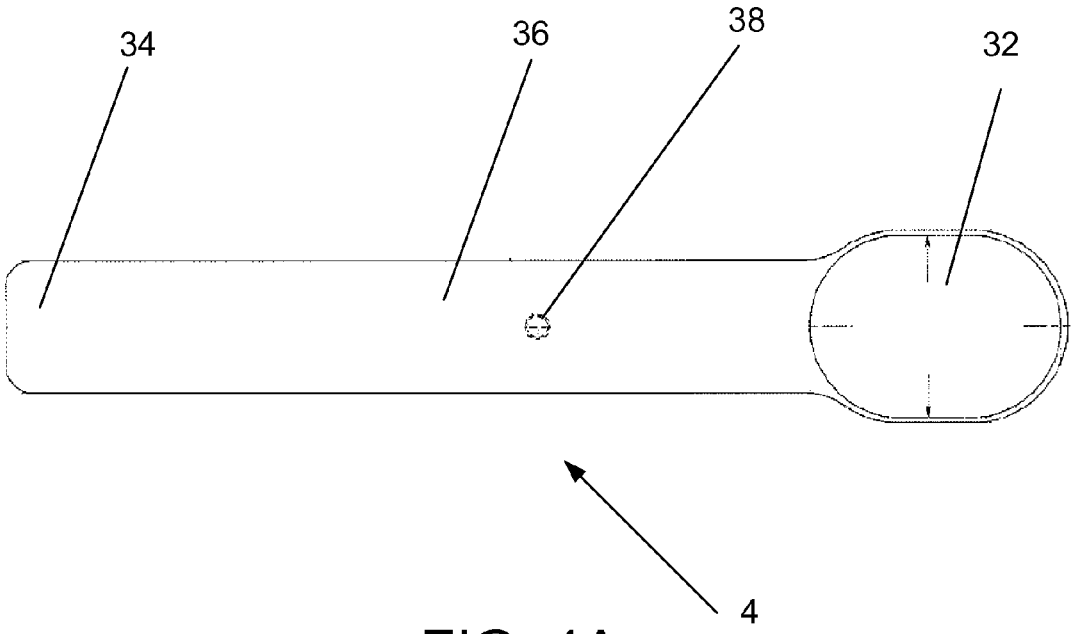
FIGS. 4A and 4B show views of a utensil.
Figure 4B:
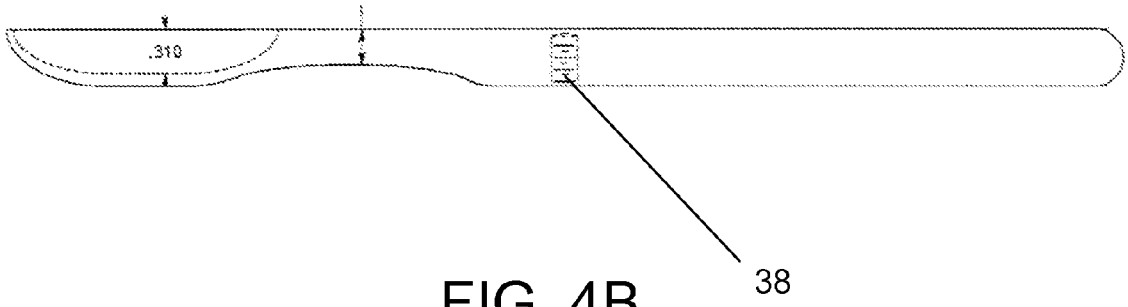
Figure 4C:
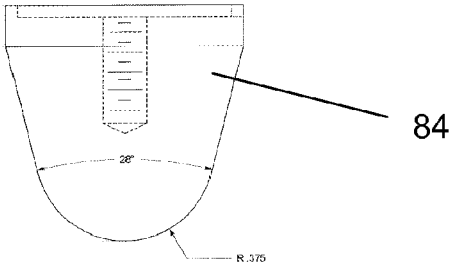
FIG. 4C shows a view of a utensil weight attachment.

In various exemplary embodiments, the present invention comprises an apparatus allowing an individual to feed himself or herself without the use of their hands and without requiring assistance. As seen in FIGS. 1-3, in several embodiments the invention comprises an eating utensil 4 that is held by a utensil holder 6 mounted on the top of a rotating shaft 8. The rotating shaft 8 is fixedly attached to a rotary disk 10. The rotary disk is connected directly or indirectly (i.e., through a fixed shaft 18) to a waveform block 50, the bottom of which comprises a sinusoidal or waveform face 52 (i.e., with two or more high points and two or more low points). The waveform block is fixed with respect to the rotary disk, and rotates therewith. The sinusoidal/waveform face 52 movably sits on two or more rollers 40, which are mounted on the top of a roller block 16. The roller block 16 is fixedly mounted on a base 14. The base is weighted so as to provide a stable and secure platform for the apparatus. The roller block may be unitary with the base, or be attached with a screw, bolt or other similar means. A central shaft may extend through the center of some or all of the components to help maintain vertical alignment.

In use, the utensil holder 4, rotating shaft 8, rotary disk 10, and waveform block 50, all rotate in unison, while the roller block 16 and base 14 remain fixed. The sinusoidal/waveform face 52 rotates on the rollers 40. The user can cause the rotation of the upper elements of the apparatus through a variety of means, including, but not limited to, using their chin, cheek, or other body part to push one end of the utensil 4 to either side when the utensil is in the holder 6. The utensil is held in place by one or more prongs 26 extending upward from the top of the holder 6, although other means of securing the utensil can be used, such as a slot or indentation in the top of the holder.

The utensil can be any utensil usable for eating, including, but not limited to, some form of a spoon, fork, or combinations thereof. As shown in the figures, the utensil may comprise a type of spoon, with one end comprising the bowl 32, and the handle end 34 counterweighted to balance the bowl when loaded with a normal portion of food. The handle end 34 is sized appropriately to allow the user to pick up the utensil with their mouth, and manipulate the utensil while thus held. The shaft of the utensil 36 is appropriately dimensioned to fit securely within the top of the holder 6, but also allow the user to easily place or remove the utensil on the holder through manipulation of the handle end when held in the mouth. In one embodiment, the shaft of the utensil comprises a hole or indentation 38 that passes partway or wholly through the shaft, and is positioned to engage a tab or post extending from the top of the rotary shaft. This helps the user position the utensil in a balanced position, and secures the utensil until the user lifts the utensil off of the holder.

The utensil may be made of any suitable material, including, but not limited to, metal, plastic, wood, or combinations thereof. In one embodiment, the handle end 34 is made of a plastic that allows the user to securely engage and hold the utensil with their teeth.

In one particular embodiment, a utensil weight attachment 84, as seen in FIG. 8C, may be attached to the underside of the shaft of the utensil by means of the hole 38. The utensil weight slopes to a rounded end, and is inserted into a corresponding opening in the top of the utensil holder 4 between the prongs. It may be weighted to help hold the utensil in the proper orientation, and to help hold it in place in the holder. The sloping and rounded shape assists with insertion and removal without the use of hands.

The rotary disk 10 generally resists rotation unless the user causes rotation of the upper elements of the apparatus as described above. Resistance can be provided through the position of the sinusoidal/waveform face 52 as the waveform block rests on the rollers 40. As the upper portion of the device rotates, the high points and the low points of the sinusoidal/waveform face 52 come into sequential contact with the rollers, so that the apparatus has at least two positions where the relative position of the upper and lower portions of the apparatus are stable (i.e., the upper portion will not rotate from that position without the user applying a force in either direction, as described above). In the embodiment shown in FIGS. 1 and 2, the stable positions are when the sinusoidal or waveform "low points" (relative to the top of the waveform block) are sitting on the rollers. Gravity keeps the upper portion of the apparatus in this position. Movement from these positions require moving the upper portion upwards against gravity as the upper portion rotates.

As seen in FIG. 3, the waveform face may be very close to or at the underside of the rotary disk, either in the form of a low profile waveform block attached to or integrated with the rotary disk, or the waveform face may be part of the rotary disk itself. The waveform face may thus interact with rollers in a roller block at the top of a fixed shaft 19 fixedly attached to the base 14. Alternatively, the rollers may be located in the top of the fixed shaft 19 itself, or the top of the fixed shaft may comprise a waveform face itself, to correspond with the waveform face of the upper apparatus. In yet a further alternative embodiment, the rollers may be placed in the top of the base.

It should be noted that the positions of the waveform block and roller block can be exchanged, so that the roller block is associated with the upper portion of the apparatus, while the waveform face is associated with the base or lower portion. Further, it should be noted that the point of rotation can be located at several points along the shafts (e.g., a single shaft can extend from the top to the base, with the shaft rotating on the fixed base). In addition, stability can be further enhanced by a non-rotating center reinforcement rod or shaft that extends through a central channel or hole in the middle of the rotating shaft, waveform block, and rotary disk and is embedded in or extends through the center of the roller block, fixed shaft, or base, or combinations thereof.

Figure 7A:
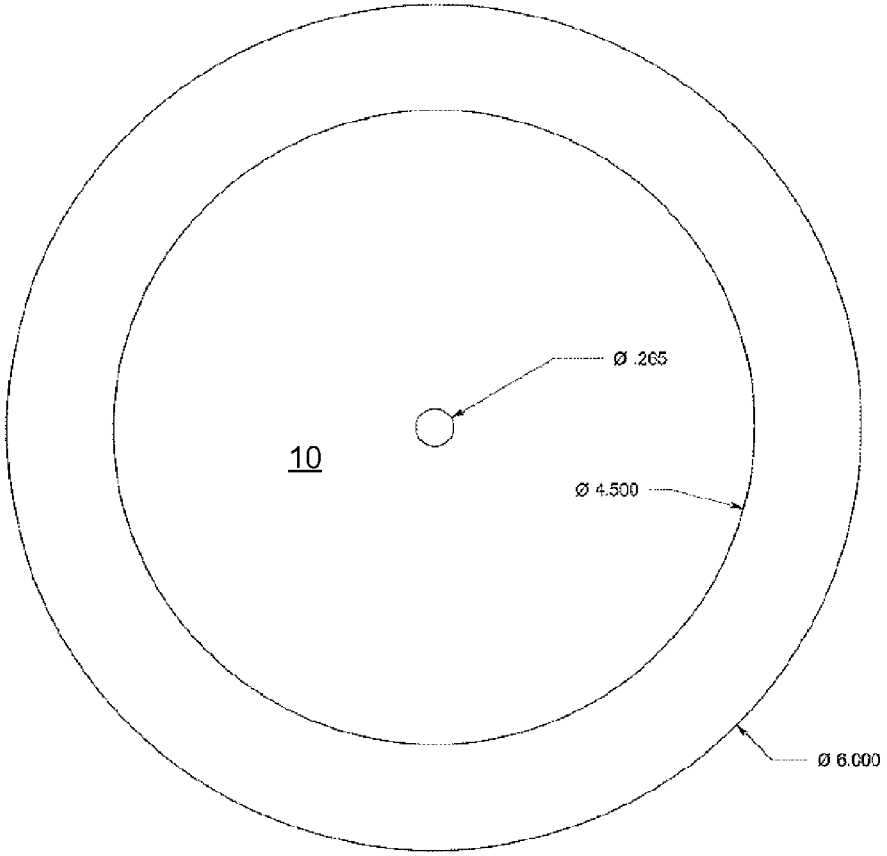
FIG. 7A shows a top view of a rotary disk.
Figure 7B:
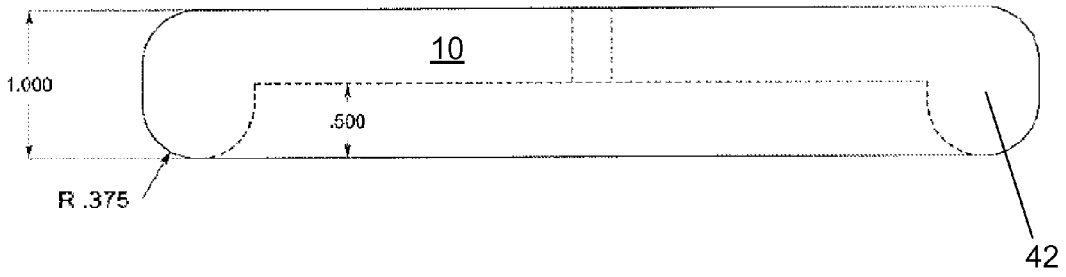
FIG. 7B shows a side view of a rotary disk.

In several embodiments, as seen in FIGS. 7A-B, the rotary disk is weighted so as to assist in positioning of the upper portion of the assembly. The rotary disk may vary in thickness, so that the weight is distributed more along the perimeter 42. As the user initiates movement, the sinusoidal or wave form of the upper assembly moves relative to the other, until it reaches a point where the forces cause the upper assembly to the next stable position. In the embodiment shown, the upper portion thus rotates from stable position at 0 degrees, through the maximum unstable position at 90 degrees, to another stable position at 180 degrees. This enables the user to place the utensil on the utensil mount, and rotate it 180 degrees so that he or she can engage the bowl end 32 and consume food items thereon.

Figure 5A:
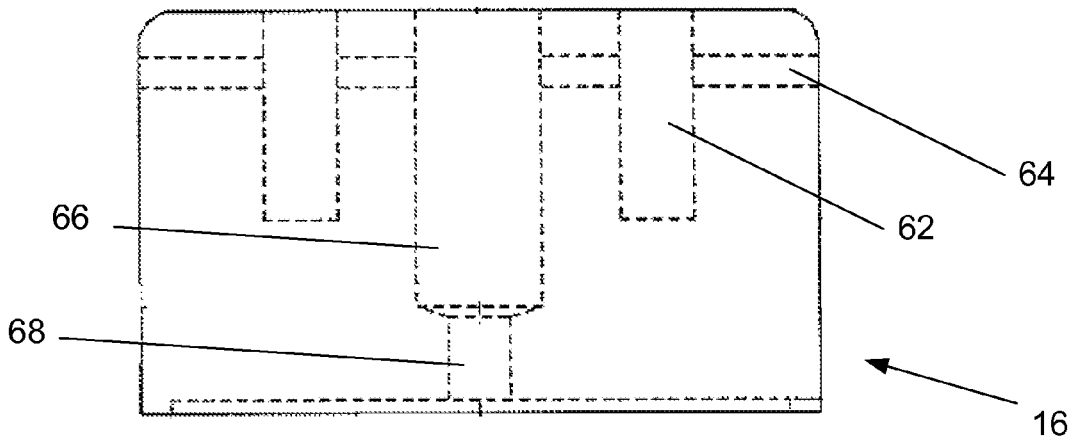
FIG. 5A shows a side view of a roller block.
Figure 5B:
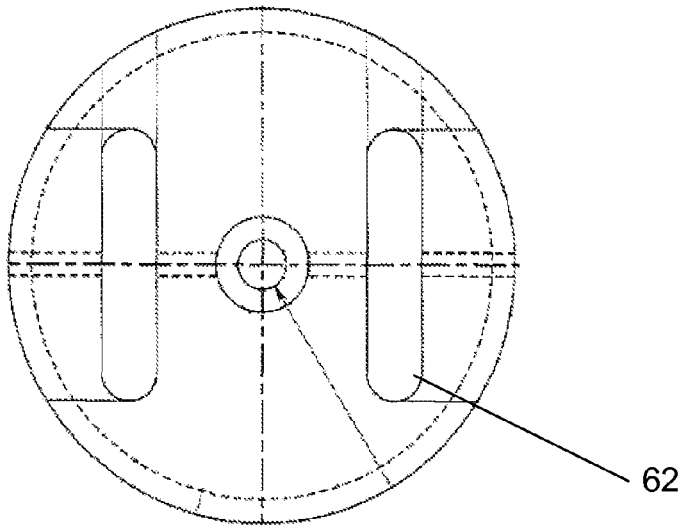
FIG. 5B shows a top view of a roller mount.
Figure 6A:
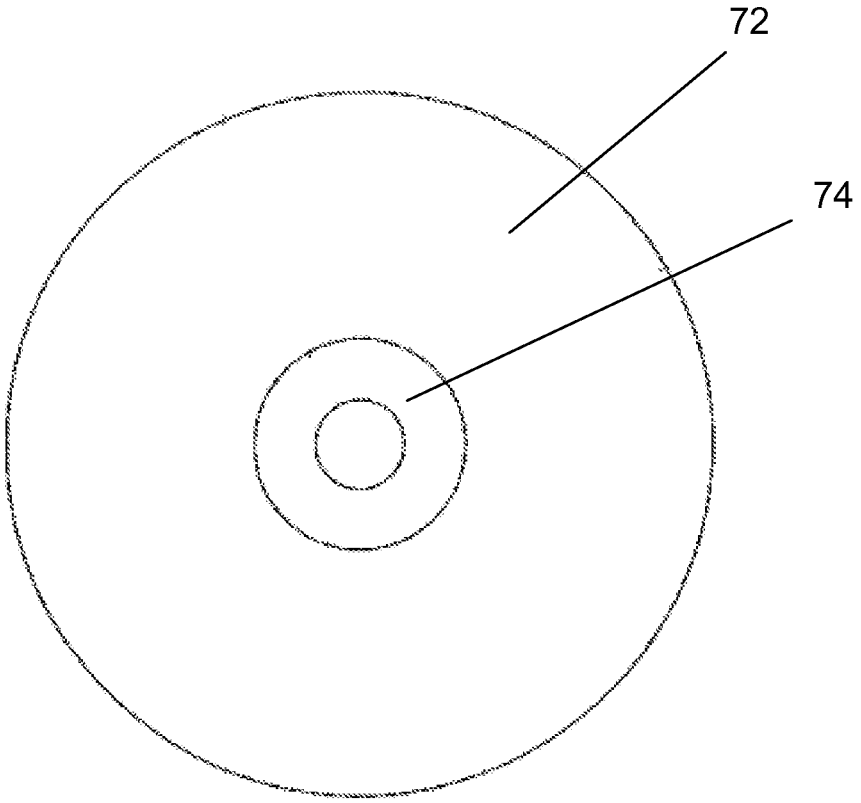
FIG. 6A shows a side view of a roller.
Figure 6B:
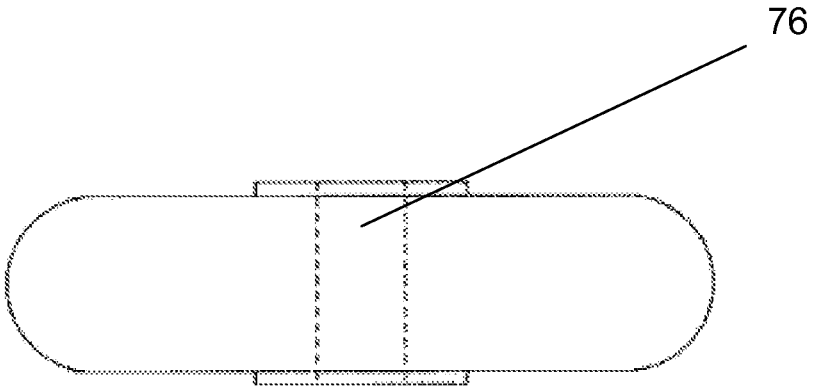
FIG. 6B shows a top view of a roller.

FIGS. 5A and 5B show views of one embodiment of the roller block 16. Two wells 62 in the top of the roller block hold the rollers 15 (as seen in FIGS. 6A and 6B). One or more horizontal bores 64 allow for the insertion of an axle around which the wheel-like roller rotates. Alternatively, the wells may include one or more slots or holes along the sides into which the ends of an axle extending to either side of the roller may be received or held. Rollers may comprise an outer circular portion 72 made of rubber, plastic, or other suitable material, mounted on a center hub 74. The center hub comprises a central hole 76 adapted to receive or hold an axle.

Figure 11:
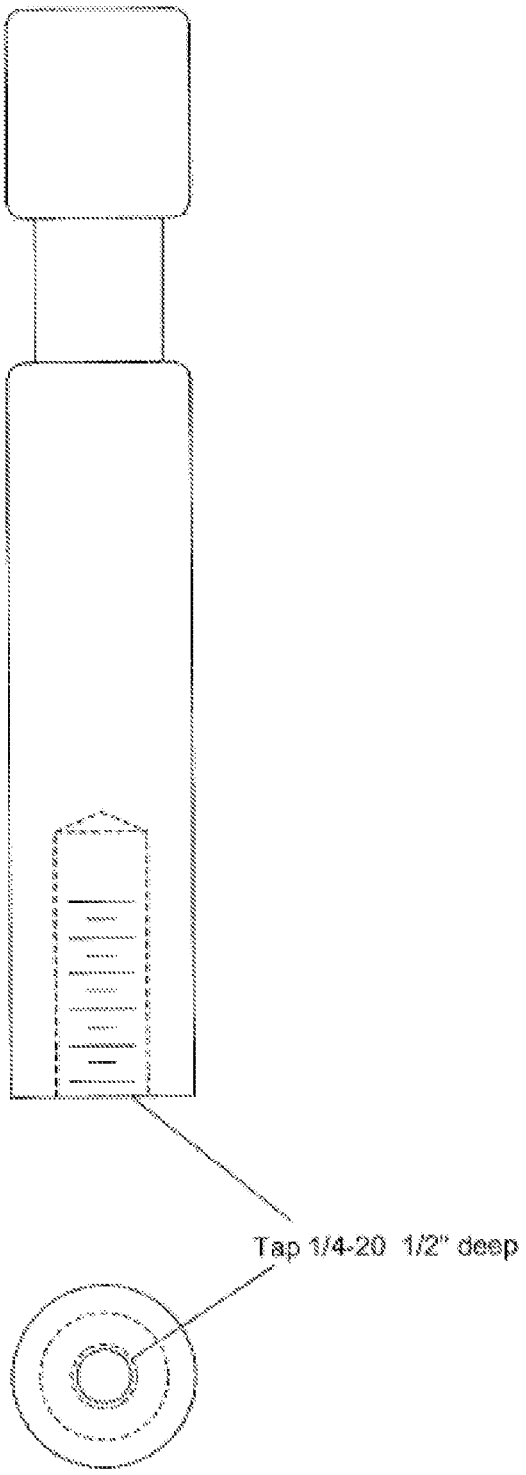
FIG. 11 shows a side view of an center shaft section.

The roller block may comprise a central bore with an upper portion 66 and a lower portion 68. The lower portion may be used to fasten the roller block to the base by means of a screw or bolt or similar fastening means. The upper portion 66 may be used to insert the bolt or screw into the lower portion 68, and also may be used to receive or hold the lower end of a central shaft or rod 92, as seen in FIG. 11. The central shaft or rod shown in FIG. 11 is inserted into the corresponding bores in the roller block and the waveform form, and then secured fastened at one end to either (but not both simultaneously).

Figure 8A:
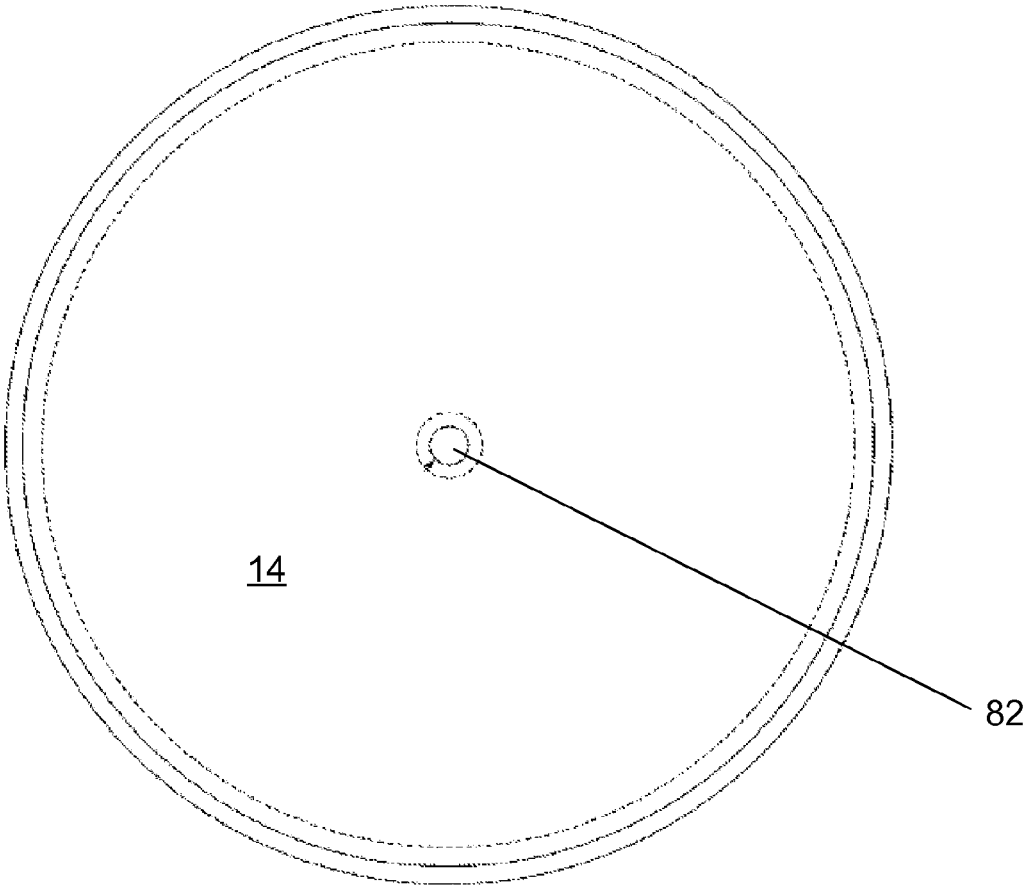
FIG. 8A shows a top view of a base.
Figure 8B:
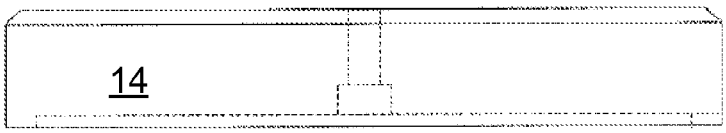
FIG. 8B shows a side view of a base.

FIGS. 8A-B show a base 14 adapted to receive a roller block as seen in FIGS. 5A-B. A central bore 82 aligns with the lower portion 68 of the central bore of the roller block, so that a bolt or similar fastening means can be inserted therein. An end cap may be used to secure the end of the bolt to the base (the end cap may be inserted into a wider counterbore in the bottom of the base). The end cap may be threaded on the interior, forming a cap screw.

Figure 9:
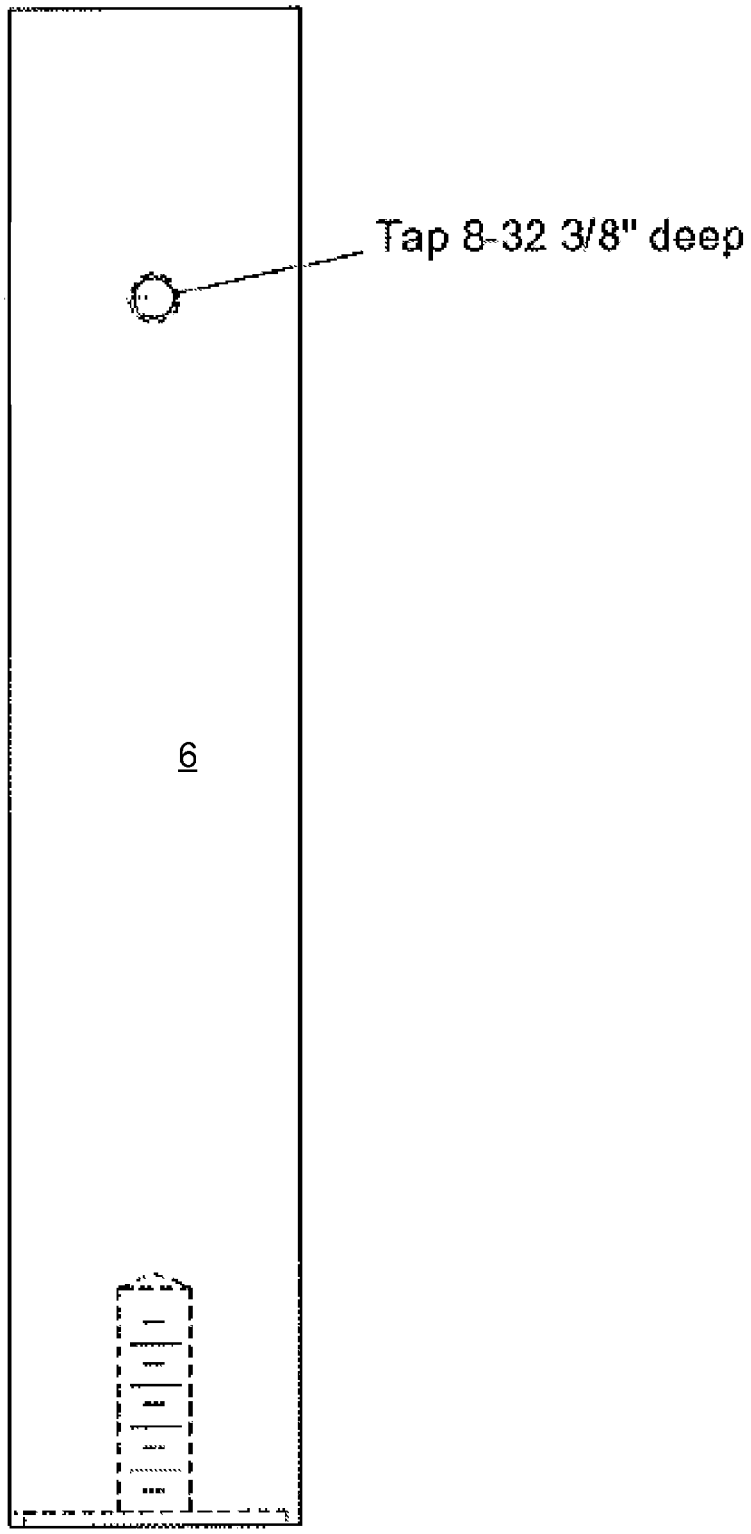
FIG. 9 shows a side view of a rotating shaft section.
Figure 10A:
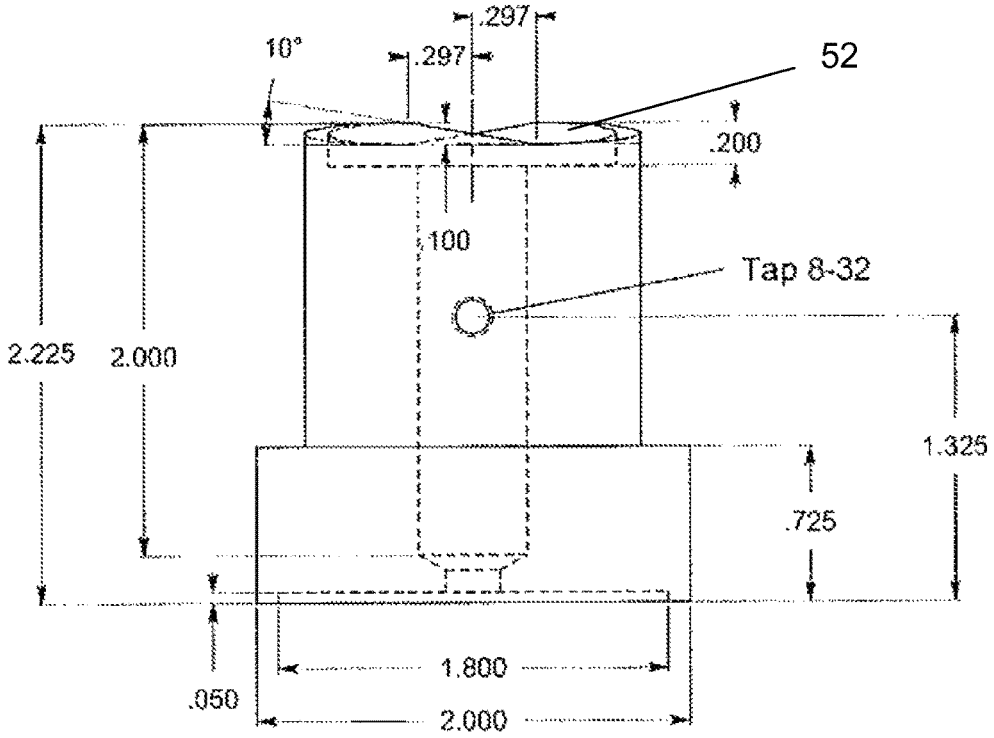
FIGS. 10A and 10B show side views of a waveform block with waveform face.
Figure 10B:
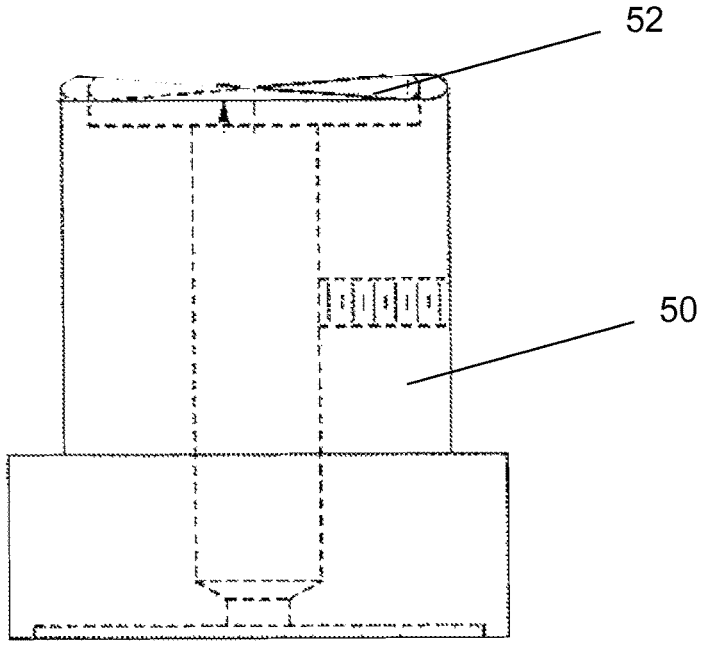

FIG. 9 shows an example of a rotating shaft 6. The bottom of the shaft may comprise a bore for receiving a bolt or screw to fasten the rotating shaft to the rotary disk. The top is adapted to receive the utensil holder, although the utensil holder may be integrated with the rotating shaft and form its top. In the embodiment shown, a tap hole is provided to secure the utensil holder to the shaft.

The apparatus can be made of a variety of suitable material, including, but not limited to, metal, plastic, wood, or combinations thereof. The materials should be such so as to be washable or otherwise sanitizable.

A method of using the present invention comprises the following:

(a) The user grasps the handle end of the utensil in his or her mouth, and lifts it off the utensil mount.

(b) The user manipulates the utensil to use the bowl end to obtain a portion of food (e.g., removes food from a plate or bowl using the bowl end of the utensil).

(c) The user mounts the utensil on the utensil mount.

(d) The user pushes the handle end in either direction with his or her chin, causing the utensil and the upper portion of the apparatus to rotate 180 degrees (i.e., so the bowl end faces the user).

(e) The user consumes the food from the bowl end.

(f) The user pushes the bowl end in either direction to cause the utensil to rotate 180 degrees to its starting position.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A self-feeding apparatus, comprising:

a weighted base;

a utensil mount connected to the weighted base by one or more shafts, wherein the utensil mount rotates with respect to the weighted base;

a rotary disk positioned between the weighted base and the utensil mount, wherein the rotary disk rotates in conjunction with the utensil mount;

an eating utensil removably secured to the utensil mount, wherein the eating utensil rotates in conjunction with the utensil mount when secured thereto; and a roller block with two or more wheels or rollers mounted thereon, and a waveform block with a waveform face thereon in contact with said one or more wheels or rollers to form a rotary interface disposed between rotary disk and the base.

2. The apparatus of claim 1, wherein the eating utensil comprises a spoon.

3. The apparatus of claim 1, wherein the eating utensil comprises two ends, a food-holding end and a handle end, wherein the handle end is weighted such that the eating utensil is balanced on the utensil mount.

4. The apparatus of claim 1, the utensil mount comprises a pair of prongs adapted to secure the eating utensil therebetween.

5. The apparatus of claim 1, wherein the one or more shafts comprise an upper portion extending between the utensil mount and the rotary disk.

6. The apparatus of claim 1, wherein said waveform face comprises two or more high points and two or more low points.

7. The apparatus of claim 6, wherein the rotary interface has two stable positions wherein rotation of the utensil mount is resisted.

8. The apparatus of claim 7, wherein the stable positions are 180 degrees in opposition.

9. A method of using an apparatus as described in claim 1, comprising the steps of:

grasping a handle end of the utensil with the mouth;

lifting the utensil off the utensil mount;

manipulating the utensil to obtain a portion of food on a food end opposite the handle end;

placing the utensil on the utensil mount;

rotating the utensil and utensil mount 180 degrees by pushing the handle end in either direction; and consuming the portion of food on the food end.

10. The method of claim 9, wherein all steps are performed without the use of hands.

* * * * *